US009160108B2

(12) United States Patent
Kamiya

(10) Patent No.: US 9,160,108 B2
(45) Date of Patent: Oct. 13, 2015

(54) LEVER CONNECTOR

(71) Applicant: YAZAKI CORPORATION, Tokyo (JP)

(72) Inventor: Jun Kamiya, Aichi (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/379,053

(22) PCT Filed: Feb. 20, 2013

(86) PCT No.: PCT/JP2013/054194
§ 371 (c)(1),
(2) Date: Aug. 15, 2014

(87) PCT Pub. No.: WO2013/125585
PCT Pub. Date: Aug. 29, 2013

(65) Prior Publication Data

US 2015/0037089 A1 Feb. 5, 2015

(30) Foreign Application Priority Data

Feb. 20, 2012 (JP) ..... 2012-034171

(51) Int. Cl.
*H01R 13/629* (2006.01)
*H01R 43/26* (2006.01)

(52) U.S. Cl.
CPC ..... *H01R 13/62938* (2013.01); *H01R 43/26* (2013.01)

(58) Field of Classification Search
CPC ..... H01R 13/62933; H01R 13/62988; H01R 13/62955
USPC ..... 403/321, 322.4, 353, 349, 350; 439/152, 153, 157, 159, 160
See application file for complete search history.

(56) References Cited

U.S. PATENT DOCUMENTS 5,171,156 A * 12/1992 Nagasaka et al. ..... 439/157
5,445,530 A * 8/1995 Inoue et al. ..... 439/157

(Continued)

FOREIGN PATENT DOCUMENTS

JP 6-231830 A 8/1994
JP 7-226260 A 8/1995

(Continued)

OTHER PUBLICATIONS

International Search Report and Written Opinion of the International Search Report for PCT/JP2013/054194 dated May 21, 2013.

(Continued)

*Primary Examiner* — Daniel Wiley
(74) *Attorney, Agent, or Firm* — Kenealy Vaidya LLP

(57) ABSTRACT

A fitting lever (30) includes a pair of lever bodies (31), shaft fitting holes (32) which are formed on opposed inner surface (31*a*) of a pair of lever bodies (31) and in which lever supporting shafts (11) of a firs connector housing (10) are pivotably fitted, cam grooves (34) which are formed to open at the end edges of the lever bodies (31) at the side of a second connector housing (20) and which act a moving force in a fitting direction on action receiving shafts (23) with the pivoting of the lever bodies (31) when the fitting lever (30) is pivoted while the connector housings are aligned at a fitting start position.

6 Claims, 11 Drawing Sheets

(56) References Cited

U.S. PATENT DOCUMENTS

| | | | | |
|---|---|---|---|---|
| 5,499,926 | A * | 3/1996 | Akeda | 439/157 |
| 5,551,885 | A * | 9/1996 | Yamanashi et al. | 439/157 |
| 5,575,672 | A | 11/1996 | Katsuma | |
| 5,616,038 | A | 4/1997 | Okamoto et al. | |
| 6,254,409 | B1 | 7/2001 | Okabe et al. | |
| 6,341,968 | B1 | 1/2002 | Grant | |
| 7,384,286 | B2 * | 6/2008 | Imai et al. | 439/157 |
| 7,442,058 | B2 * | 10/2008 | Ohtaka et al. | 439/157 |
| 2005/0098419 | A1 * | 5/2005 | Matsui et al. | 200/311 |
| 2006/0240693 | A1 * | 10/2006 | Nishide | 439/157 |
| 2006/0281351 | A1 * | 12/2006 | Yamaoka | 439/157 |
| 2009/0023316 | A1 * | 1/2009 | Takahashi et al. | 439/157 |
| 2015/0017825 | A1 * | 1/2015 | Kamiya | 439/153 |

FOREIGN PATENT DOCUMENTS

| | | | |
|---|---|---|---|
| JP | 8-78089 | A | 3/1996 |
| JP | 9-320682 | A | 12/1997 |
| JP | 2000-357559 | A | 12/2000 |
| JP | 2002-231379 | A | 8/2002 |
| JP | 3442661 | B2 | 9/2003 |

OTHER PUBLICATIONS

The English translation of the Written Opinion of the International Search Report for PCT/JP2013/054194 dated May 21, 2013.

* cited by examiner

LEVER CONNECTOR

TECHNICAL FIELD

The present invention relates to a lever connector.

BACKGROUND ART

FIG. 19 shows an example of traditional lever connectors. This lever connector 100 which is disclosed in a patent document 1 below includes a first connector housing 110, a second connector housing 120 which is fitted and connected with the first connector housing 110, and a fitting lever 130 which is pivotably installed to the first connector housing 110.

The second connector housing 120 has an outer sheath wall part (hood part) 121 into which the first connector housing 110 is inserted.

The fitting lever 130 is a member by which an operating force to fit/detach the first connector housing 110 into/from the second connector housing 120 can be reduced, and is pivotably installed to shafts 111 which are protruded from the outer side surfaces of the first connector housing 110.

As shown in the figure, the fitting lever 130 includes a pair of lever bodies 131 which are arranged to be opposite to each other so that a pair of outer side surfaces of the first connector housing 110 are sandwiched, a joint member 132 that connects the pair of lever bodies 131 at one end side, pivoting fulcrum holes 133 which are formed in the lever bodies 131 and are pivotably engaged with the shafts 111 on the outer side surfaces of the first connector housing 110, and action point protruding parts 134 which are engaged with lever retaining holes 122, which are formed at the outer side surfaces of the outer sheath wall part 121, when a fitting operation begins after the first connector housing 110 and the second connector housing 120 are aligned to a fitting start position.

In the illustrated example, the joint member 132 also serves as a force point part which receives the operating force when the lever bodies 131 are pivoted around the shafts 111.

For the lever connector 100 of the patent document 1, the first connector housing 110 is fitted and connected with the second connector housing 120 with the following steps.

First, as shown in the figure, the fitting operation lever 130 is pivotably attached to the first connector housing 110. Then, as shown by an arrow X1 in FIG. 19, the front end of the first connector housing 110 is inserted into the outer sheath wall part 121 of the second connector housing 120, the first connector housing 110 and the second connector housing 120 are aligned to the fitting start position, and the action point protruding parts 134 of the fitting lever 130 are engaged with the lever retaining holes 122 of the second connector housing 120.

Then, the joint member 132 of the fitting lever 130 is pressed down, and as shown by the arrow R1 in FIG. 19, the fitting lever 130 is pivoted. The second connector housing 120 is drawn toward the first connector housing 110 with the pivoting movement of the fitting-operation lever 130, and the connector housings have been fitted with each other.

When the connector housings fitted with each other are to be detached, the joint member 132 is pivoted in a direction opposite to the direction shown by the arrow R1 in FIG. 19 so that the connector housings are detached from each other.

CITATION LIST

Patent Literature

PTL1: Japan Patent No. 3442661

SUMMARY OF THE INVENTION

Problem to be Solved by the Invention

However, in the case of the lever connector 100 of the patent document 1, the fitting lever 130 cannot be removed from the first connector housing 110 when the connector housings are fitted with each other.

Therefore, in the case of the lever connector 100 of the patent document 1, even when the connector housings are actually used after the connector housings have been fitted and connected with each other, the weight of the fitting lever 130 is added so that the weight of the connector is increased.

In the case of the lever connector 100 of the patent document 1, the lever connector 100 must be accompanied by the fitting lever 130, and there is a problem which is that the cost is increased because of the increase of the component number.

The object of the present invention is to solve the above problems and provide a lever connector which makes it possible to reduce the cost due to the reduction of the component number and reduce the weight in a use state.

Solution to Problems

The above-mentioned object of the present invention is achieved by the following constructions.

(1) A lever connector includes a first connector housing, a second connector housing which is fitted and connected with the first connector housing, and a fitting lever which is pivotably installed to the first connector housing as a lever member to reduce the operating force to fit and detach the first connector housing with and from the second connector housing. The first connector housing includes a pair of lever supporting shafts which are respectively protruded from a pair of outer surfaces of the first connector housing and with which the fitting lever is pivotably fitted. The second connector housing includes an outer sheath wall which is fitted to the outer circumference of the first connector housing, a pair of fulcrum shaft guiding slots which are formed by cutting a pair of side walls of the outer sheath wall which face the pair of outer surfaces of the first connector housing along the fitting direction of the connector housings so that when the connector housings are fitted with each other, the lever supporting shafts project outward from the side walls and are movable in the fitting direction of the connector housings, and a pair of action receiving shafts which are lined up in parallel with the lever supporting shafts that project from the fulcrum shaft guiding slots and which are protruded from the outer surfaces of the pair of side walls so that distal ends of the action receiving shafts project slightly from distal ends of the lever supporting shafts that project from the fulcrum shaft guiding slots. The action receiving shafts includes retaining flanges that project radially outward from the circumferences of the distal ends of the shafts. The fitting lever includes a pair of lever bodies whose inner surfaces are arranged to face each other, shaft fitting holes which are formed as recesses on the inner surfaces of the lever bodies so that when the lever bodies are moved along the central axis of the lever supporting shafts from the outsides of the lever supporting shafts to the insides of the shafts, a lever supporting shafts fitted state is obtained which is that the lever supporting shafts are pivotably fitted, and when the lever bodies are moved from the lever supporting shafts fitted state along the central axis of the lever supporting shafts to the outsides of the lever supporting shafts, a lever supporting shafts detached state is obtained which is that the lever supporting shafts are detached, initial fitting engaging grooves which are formed to open at the end edges of the lever bodies at the side of the second connector housing, and in which the action receiving shafts are engaged when the first connector housing and the second connector housing are aligned at a fitting start position while the lever bodies which are fitted with the lever supporting shafts of the first connector housing are located at a pivoting initial position, cam grooves which follow the initial fitting engaging grooves and which deepen the fitting of the connector housings by acting a moving force in the fitting direction on the action receiving shafts which are located in the initial fitting engaging grooves with the pivoting of the lever bodies when the lever bodies is pivoted from the pivoting initial position to a pivoting final position, lever retaining flanges which are formed to project on the opening edges of the initial fitting engaging grooves and the cam grooves except final end areas of the cam grooves where the action receiving shafts arrive when the lever bodies arrive at the pivoting final position to abut against the inner surface of the retaining flanges, so that that the movement of the lever bodies outward in the axial direction of the action receiving shafts is regulated except the final end areas and is permitted in the final end areas, a coupling mechanism which couples the pair of lever bodies to be movable in the opposing direction from a minimum separation position corresponding to the lever supporting shafts fitted state to a maximum separation position corresponding to the lever supporting shafts detached state, and resilient members which urge the pair of lever bodies in such a direction that the separation distance between the pair of lever bodies increases.

(2) In the lever connector according to (1), the coupling mechanism includes a coupling member which is arranged between the pair of lever bodies, guiding shafts which project from the lever bodies toward the coupling member, guiding holes which are formed as recesses on the end surfaces of the coupling member that face the lever bodies and in which the guiding shafts are fitted slideably in the opposing direction of the pair of lever bodies, and stoppers which stop the movement of the guiding shafts that are fitted in the guiding holes to a detaching direction when the pair of lever bodies move to the maximum separation position, and the resilient members are springs which press to urge the guiding shafts, which are installed in the guiding holes, outward.

(3) In the lever connector according to (2), the stoppers are screw members which are inserted through screw through holes with which the lever bodies are formed and are screwed to the coupling member.

According to the construction of the above (1), while the fitting lever is in a no load state which is that an external force to make the pair of lever bodies approach each other is not received, the lever bodies are maintained at the maximum separation position by the urging force from the resilient member. While the pair of lever bodies are maintained at the maximum separation position, the pair of lever supporting shafts of the first connector housing can be put between the pair of lever bodies of the fitting lever. Then, while the pair of lever supporting shafts of the first connector housing are put between the pair of lever bodies, when the position of the shaft fitting holes of the pair of lever bodies are aligned to the position of the lever supporting shafts, the pair of lever bodies are pressed to move to approach each other to the minimum separation position, a lever supporting shafts fitted state, which is that the lever supporting shafts are pivotably fitted in the shaft fitting holes of the lever bodies, is obtained.

Then, while the lever bodies in the lever supporting shafts fitted state are positioned at the pivoting initial position, when the first connector housing and the second connector housing are aligned at the fitting start position, the pair of action receiving shafts of the second connector housing are engaged in the initial fitting engaging grooves of the lever bodies.

While the action receiving shafts are engaged in the initial fitting engaging grooves, the lever retaining flanges which are equipped at the opening edges of the initial fitting engaging grooves engage with the inner surfaces of the retaining flanges of the action receiving shafts to regulate the movement of the lever bodies outward in the axial direction of the action receiving shafts. That is, while the action receiving shafts are engaged in the initial fitting engaging grooves, even if the load (the operating force) which urges the pair of lever bodies to approach each other is withdrawn, it is maintained that the pair of lever bodies are located at the minimum separation position.

Then, when the fitting lever is pivoted to the pivoting final side, with the pivoting of the lever bodies, the cam grooves act a moving force in the fitting direction of the connector housings on the action receiving shafts which are located in the initial fitting engaging grooves to deepen the fitting of the connector housings with each other. Then, with the pivoting of the fitting lever, when the lever bodies arrive at the pivoting final position, the action receiving shafts arrive at the final ends of the cam grooves, and the connector housings have been fitted and connected with each other.

Because the lever retaining flanges are not equipped in the final end areas of the cam grooves, when the action receiving shafts arrive at the final ends of the cam grooves, the movement of the pair of lever bodies to the maximum separation position side is permitted due to the urging force of the resilient members. When the pair of lever bodies move to the maximum separation position, the pair of lever bodies become detached from the lever supporting shafts and the action receiving shafts. While the pair of lever bodies become detached from the lever supporting shafts and the action receiving shafts, by performing an operation of pulling out the fitting lever from the connector housings, the fitting lever can be detached from the connector housings which are fitted and connected with each other.

When the detached fitting lever is to be installed to the connector housings again, first, the fitting lever is inserted onto the connector housings which are fitted and connected with each other, and the position of the fitting lever is returned to the position where the pivoting of the lever bodies has been completed.

Then, when a load (operating force) to make the pair of lever bodies approach each other is applied to return the pair of lever bodies to the minimum separation position, a state is obtained which is that the lever bodies are engaged with the lever supporting shafts and the action receiving shafts at the pivoting final position. Then, when the fitting lever is pivoted from this state to the pivoting initial position, the connector housings can be returned to the fitting start position.

That is, according to the construction of the above (1), since after the connector housings have been fitted and connected with each other, the fitting lever is detached from the connector housings, a reduction in weight can be realized in an use state of the connector.

According to the construction of the above (1), the fitting lever which is detached from the connector housing can be used in fitting other lever connectors. Therefore, the component set of a regular lever connector only includes the first connector housing and the second connector housing but does not include the fitting lever, so that the cost can be reduced due to the reduction of the component number.

According to the construction of the above (1), when the fitting and connection of the connector housings have been completed, since the pair of lever bodies are moved to the maximum separation position due to the urging force of the resilient members, the lever bodies are detached from the lever supporting shafts and the action receiving shafts, and the fitting lever becomes detached from the connector housings automatically. However, in the middle of the fitting of the connector housings (that is, in the middle of the pivoting of the fitting lever), because the movement of the lever bodies outward in the axial direction of the action receiving shafts is regulated since the lever retaining flanges which the lever bodies are equipped with abut against the inner surfaces of the retaining flanges, the fitting lever cannot be detached from the connector housings.

In other words, for the construction of the above (1), if the fitting lever cannot be detached from the connector housings, the connector housings are in the middle of fitting (half fitted state). Thus, it is possible to determine the fitted state of the connector housings, based on whether the fitting lever is automatically detached from the connector housings, and it can be prevented that poor fitting of the connector housings with each other is overlooked.

Further, according to the construction of the above (2), since the guiding shafts are formed integrally with the lever bodies, it can be prevented that the number of components is increased, and the coupling mechanism which couples the pair of lever bodies to be movable in the opposing direction from the maximum separation position to the maximum separation position can be realized with relatively less components.

Furthermore, according to the construction of the above (3), for example, since commercially available screw members are used as the stoppers, the procurement of the stoppers becomes easy, and the manufacturing cost can be reduced.

Furthermore, if screw members are used as the stoppers, for example, by adjusting the threaded engagement depth of the screw members with the coupling member, the movable range of the pair of lever bodies in the opposing direction can be adjusted, and a design change of the movable range of the pair of lever bodies can be easily dealt with.

Effects of the Invention

According to the lever connector of the present invention, after the connector housings have been fitted with each other, the fitting lever is detached from the connector housings so that a reduction in weight can be realized in an use state of the connector.

The fitting lever which is detached from the connector housings can be used in fitting other lever connectors. Therefore, the component set of a regular lever connector only includes the first connector housing and the second connector housing but does not include the fitting lever, so that the cost can be reduced due to the reduction of the component number.

The present invention has been briefly described above. Further, details of the invention will become more apparent after embodiments of the invention described below (hereinafter referred to as "embodiments") are read with reference to the accompanying figures.

DESCRIPTION OF EMBODIMENTS

A preferred embodiment of the lever connector according to the present invention is described in detail with reference to the figures as follows.

Figure 1:
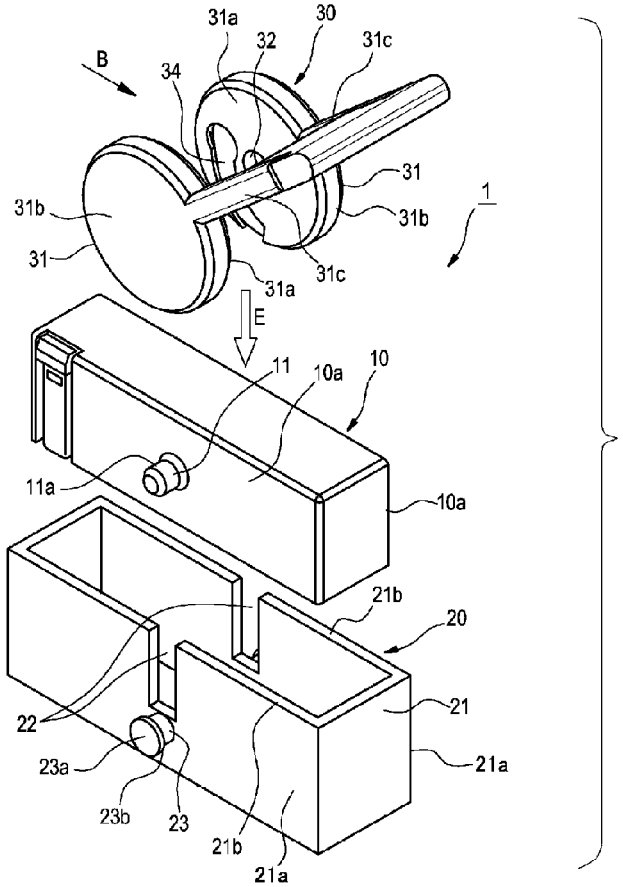
FIG. 1 is an exploded perspective view of a lever connector according to one embodiment of the present invention.
Figure 2:
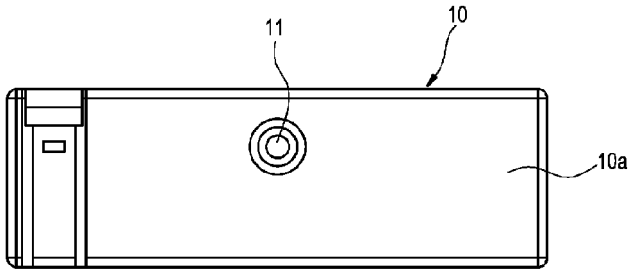
FIG. 2 is a side view of a first connector housing shown in FIG. 1.
Figure 3:
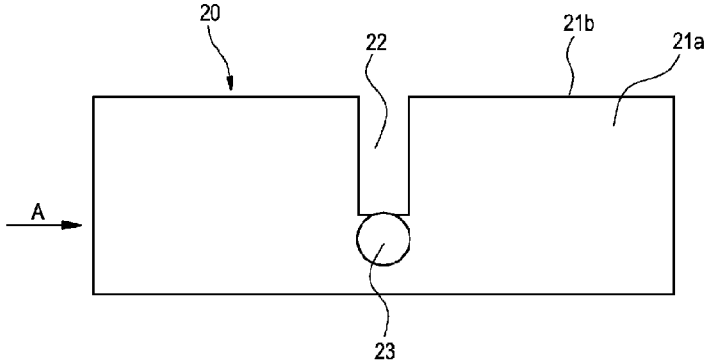
FIG. 3 is a side view of a second connector housing shown in FIG. 1.
Figure 4:
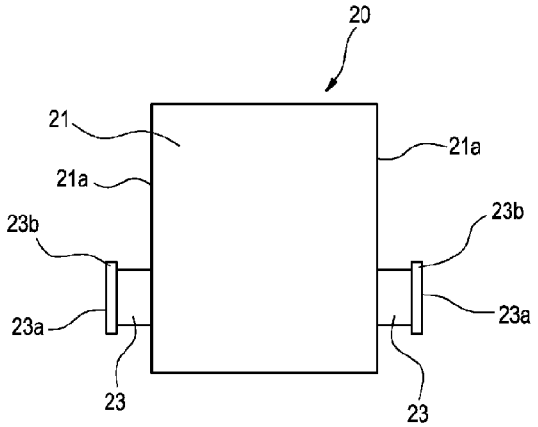
FIG. 4 is an A arrow view of FIG. 3.
Figure 5:
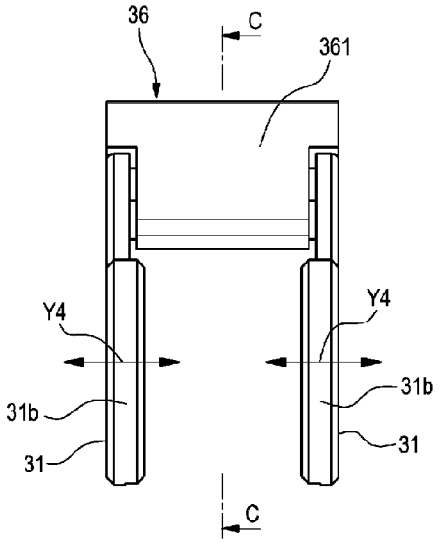
FIG. 5 is a front view (a B arrow view of FIG. 1) of a fitting lever shown in FIG. 1.
Figure 6:
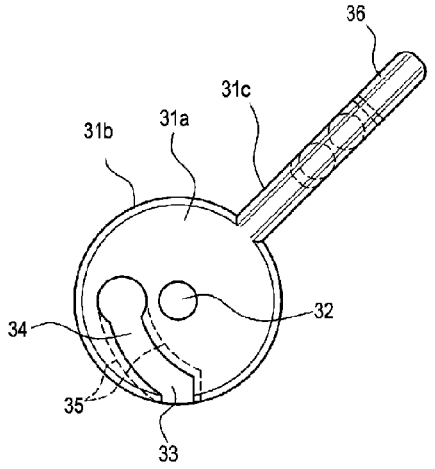
FIG. 6 is a C-C sectional view of FIG. 5.
Figure 7:
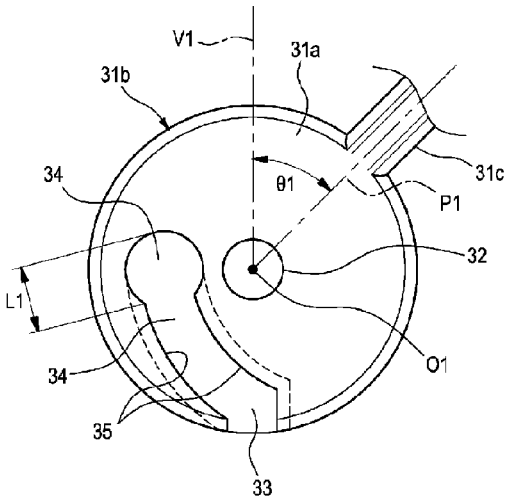
FIG. 7 is an enlarged view of main parts in FIG. 6.
Figure 8:
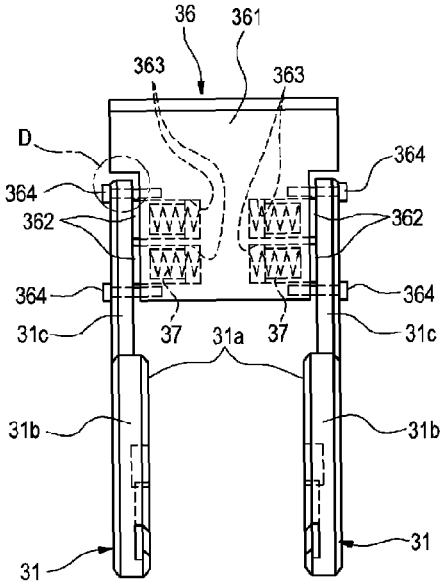
FIG. 8 is front view of the fitting lever which shows a couple structure of a pair of lever bodies in the fitting lever shown in FIG. 5 with a coupling member.
Figure 9:
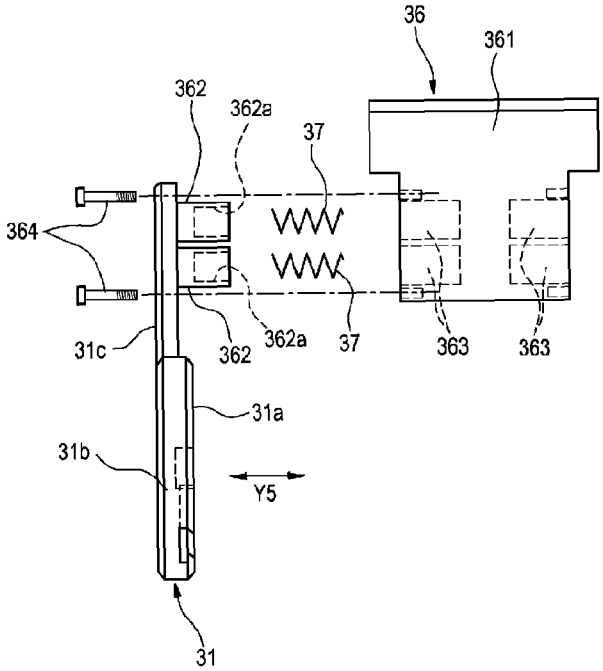
FIG. 9 is an illustrative figure which shows that the lever bodies and the coupling member shown in FIG. 8 are separated.
Figure 10:
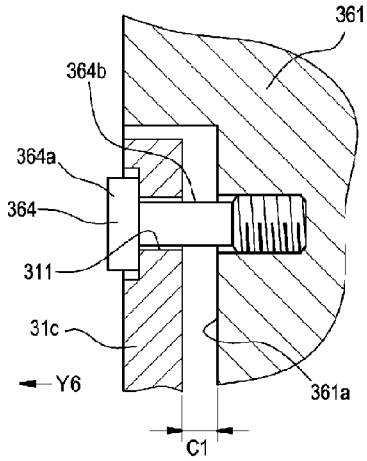
FIG. 10 is an enlarged sectional view of a D part in FIG. 8.

FIGS. 1 to 10 show a lever connector according to one embodiment of the present invention. FIG. 1 is an exploded perspective view of the lever connector of the embodiment of the present invention. FIG. 2 is a side view of a first connector housing shown in FIG. 1. FIG. 3 is a side view of a second connector housing shown in FIG. 1. FIG. 4 is an A arrow view of FIG. 3. FIG. 5 is a front view (a B arrow view of FIG. 1) of a fitting lever shown in FIG. 1. FIG. 6 is a C-C sectional view of FIG. 5. FIG. 7 is an enlarged view of main parts in FIG. 6. FIG. 8 is front view of the fitting lever which shows a couple structure of a pair of lever bodies in the fitting lever shown in FIG. 5 with a coupling member. FIG. 9 is an illustrative figure which shows that the lever bodies and the coupling member shown in FIG. 8 are separated. FIG. 10 is an enlarged sectional view of a D part in FIG. 8.

As shown in FIG. 1, a lever connector 1 of the present embodiment includes a first connector housing 10, a second connector housing 20 which is fitted and connected with the first connector housing 10, and a fitting lever 30 which is pivotably installed to the first connector housing 10.

As shown in FIGS. 1 and 2, the first connector housing 10 includes a pair of lever supporting shafts 11, 11. The pair of lever supporting shafts 11, 11 are protruded from a pair of outside surfaces 10*a*, 10*a*, respectively. The pair of lever supporting shafts 11, 11 are shafts (boss parts) to which the fitting lever 30 is pivotably fitted.

The second connector housing 20 includes a rectangular pipe-like outer sheath wall (hood part) 21 to which the outer circumference of the first connector housing 10 is fitted, a pair of fulcrum shaft guiding slots 22, 22 and a pair of action receiving shafts 23, 23, as shown in FIGS. 1, 3 and 4.

The outer sheath wall 21 has a pair of side walls 21*a*, 21*a* which are opposed to a pair of side surfaces 10*a*, 10*a* of the fitted connector housing 10.

Figure 18:
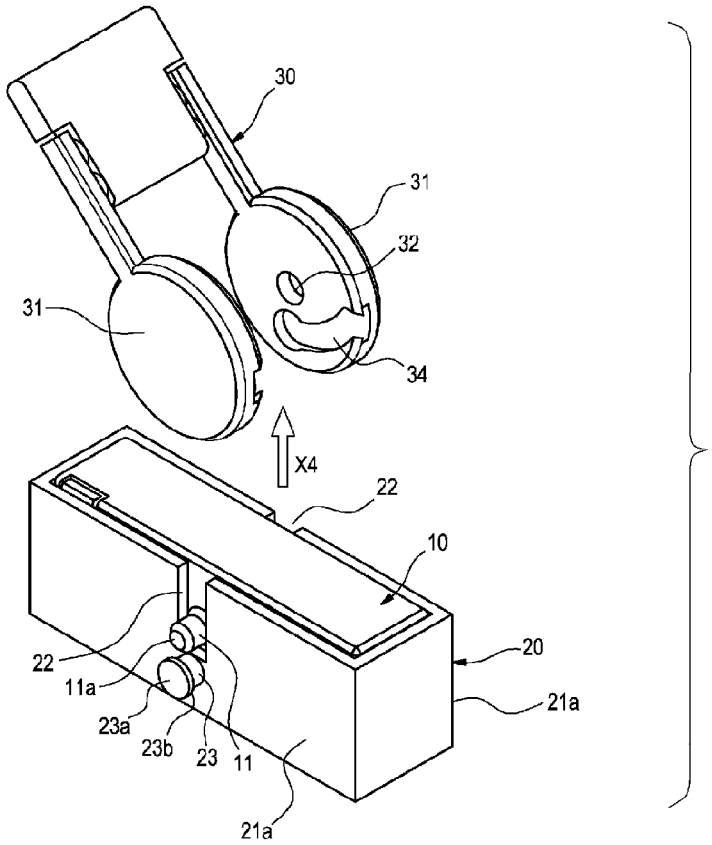
FIG. 18 is a perspective view which indicates that the fitting lever is detached from the connector housings when the fitting lever is raised upward from the state shown in FIG. 16.
Figure 19:
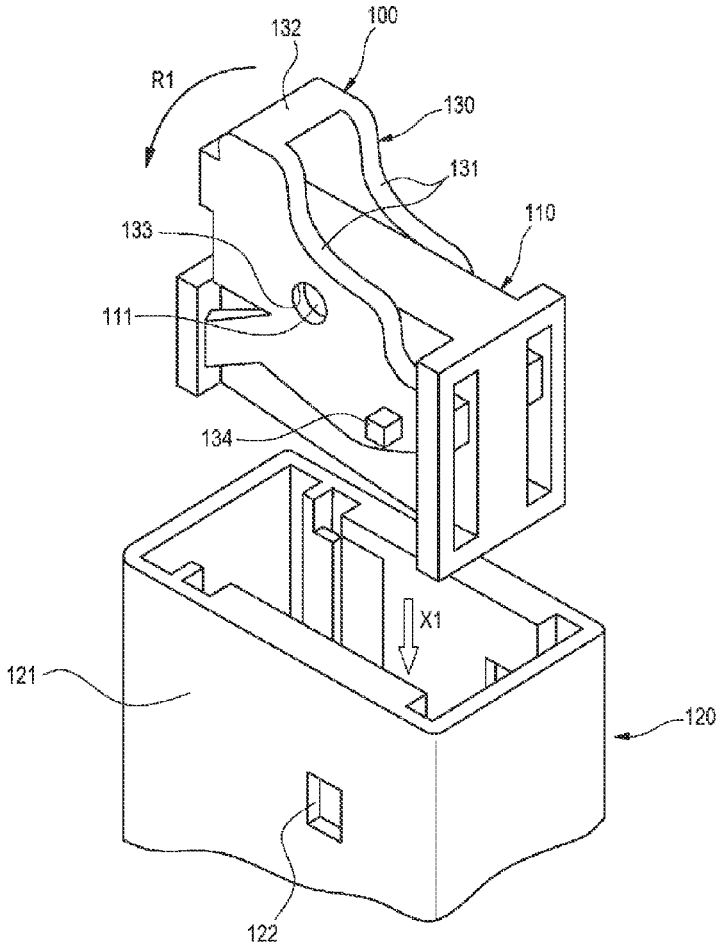
FIG. 19 RELATED ART
FIG. 19 is an exploded perspective view of a conventional lever connector.

The pair of fulcrum shaft guiding slots 22, 22 are formed by cutting the above pair of side walls 21*a*, 21*a*, respectively, to open at distal end edges 21*b* of the side walls 21*a*. The pair of fulcrum shaft guiding slots 22, 22 are slots which extend along the direction in which the connector housings 10, 20 are fitted with each other, and whose width is set to be bigger than the outer diameter of the lever supporting shafts 11. The pair of fulcrum shaft guiding slots 22, 22 are slots through which, when the connector housings 10, 20 are fitted with each other, the lever supporting shafts 11 penetrates the side walls 21*a*, as shown in FIG. 18 to be described, to project outward from the side walls 21*a*. The pair of fulcrum shaft guiding slots 22, 22 are slots in which, when the connector housings 10, 20 are fitted with each other, the lever supporting shafts 11, which penetrates the side walls 21*a*, are movable in the direction in which the connector housings 10, 20 are fitted with each other.

Figure 17:
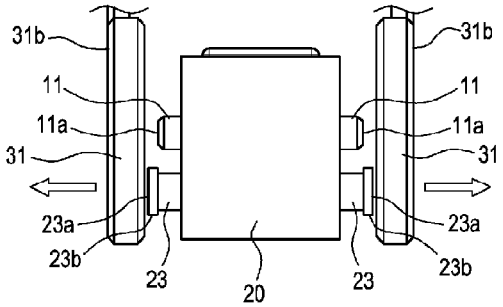
FIG. 17 is a G arrow view of main parts in FIG. 16.

The pair of action receiving shafts 23, 23 are shafts (boss parts) to receive a load in the fitting direction from the fitting lever 30, and as shown in FIG. 4, are protruded from the outer surfaces of the pair of side walls 21*a*, 21*a*, respectively. The pair of action receiving shafts 23, 23, as shown in FIG. 17 to be described later, are arranged to line up in parallel with the lever supporting shafts 11 that project from the fulcrum shaft guiding slots 22. The pair of action receiving shafts 23, 23, as shown in FIG. 17 to be described later, are set to have such a length that distal ends 23*a* of the action receiving shafts 23, 23 slightly project from distal ends 11*a* of the lever supporting shafts 11 which project from the fulcrum shaft guiding slots 22. The action receiving shafts 23, as shown in FIG. 4, have retaining flanges 23*b*, which project radially outward, at the outer peripheries of the distal ends of the shafts.

The fitting lever 30 is a member by which an operating force to fit/detach the first connector housing 10 into/from the second connector housing 20 can be reduced, and is pivotably installed to the first connector housing 10.

The fitting lever 30, as shown in FIGS. 1, 7 and 8, includes a pair of lever bodies 31, 31 which are so arranged that inner surfaces 31*a* are opposed to each other, shaft fitting holes 32, initial fitting engaging grooves 33, cam grooves 34, lever retaining flanges 35, a coupling mechanism 36 and resilient members 37.

The lever bodies 31 include circular plates 31*b* which are engaged with the connector housings 10, 20, and rod-like parts 31*c* which radially extend from the circular plates 10 31*b*. As shown in FIG. 7, the circular plates 31*b* are formed with the above-described shaft fitting holes 32, the initial fitting engaging grooves 33, the cam grooves 34 and the lever retaining flanges 35.

The shaft fitting holes 32 are holes into which the lever supporting shafts 11 are pivotably fitted, and are formed as recesses on the inner surfaces 31*a* of the circular plates 31*b* in the lever bodies 31. The shaft fitting holes 32 are arranged in the center of the circular plates 31*b*. As shown with the arrows Y2 in FIG. 11, when the circular plates 31*b* are moved along the central axis of the lever supporting shafts 11 from the outsides of the lever supporting shafts 11 to the insides of the shafts, the shaft fitting holes 32 becomes in a lever supporting shafts fitted state (state shown in FIGS. 11 and 13) which is that the lever supporting shafts 11 are pivotably fitted. As shown in FIG. 17, when the circular plates 31*b* are moved from the lever supporting shafts fitted state along the central axis of the lever supporting shafts 11 to the outsides of the lever supporting shafts 11, the shaft fitting holes 32 becomes in a lever supporting shafts detached state (state shown in FIG. 17) which is that the lever supporting shafts 11 are detached.

That is, the shaft fitting holes 32 make it possible to perform insertion/detachment to/from the lever supporting shafts 11 by moving the lever bodies 31 back and forth along the arrows Y4 shown in FIG. 5.

Figure 11:
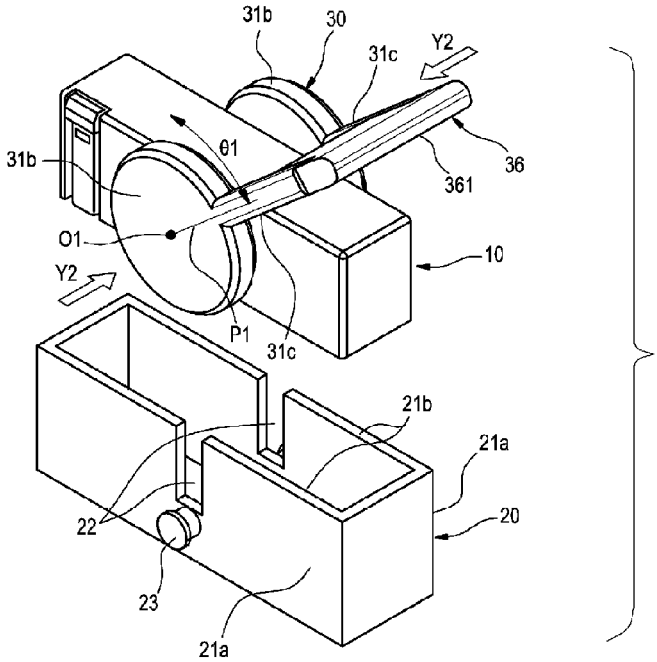
FIG. 11 is a perspective view which indicates that the fitting lever which is installed to the first connector housing is located at a pivoting start position.
Figure 12:
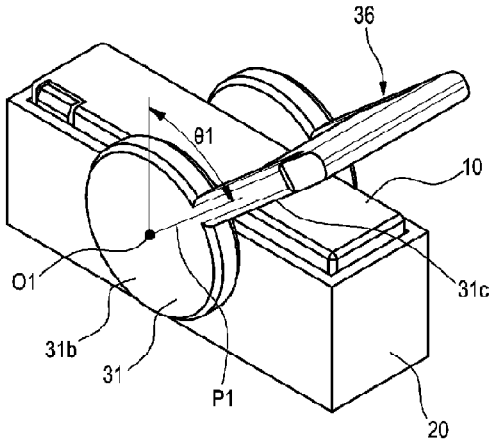
FIG. 12 is a perspective view which indicates that the fitting lever is attached to the first connector housing and the second connector housing, which are aligned at a fitting start position, at the pivoting start position.
Figure 13:
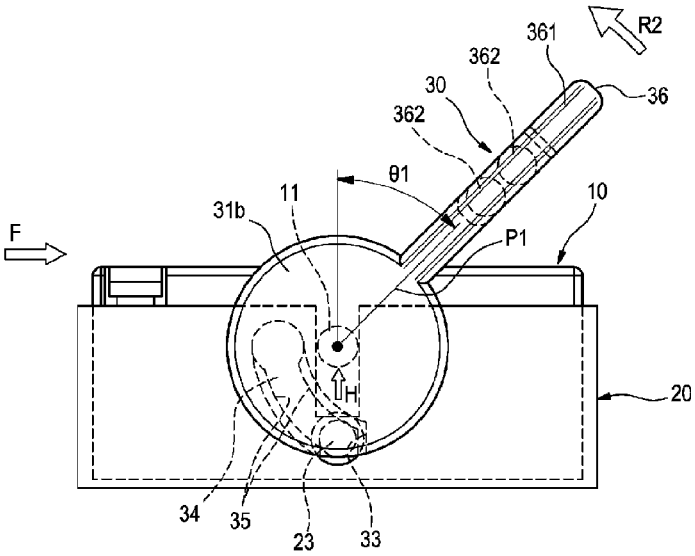
FIG. 13 is a side view of the lever connector shown in FIG. 12.

The initial fitting engaging grooves 33 are grooves to guide the action receiving shafts 23 of the second connector housing 20 to the initial ends of the cam grooves 34 when the first connector housing 10 and the second connector housing 20 are aligned to a fitting start position as shown in FIG. 12. The initial fitting engaging grooves 33 are grooves which are formed to open to the end edges of the lever bodies 31 at the side of the second connector housing 20, as shown in FIG. 7, when the lever bodies 31 are inclined to a pivoting initial position P1. The pivoting initial position P1 of the lever bodies 31 is a position where the extending direction of the rod-like parts 31*c* is inclined clockwise from a vertical line V1, which passes through a center O1 of the circular plates 31*b*, by θ1, as shown in FIG. 7. When the lever bodies 31 are inclined to the pivoting initial position P1, the initial fitting engaging grooves 33 open downward vertically. When the first connector housing 10 and the second connector housing 20 are aligned at the fitting start position as shown in FIG. 12 while the lever bodies 31 which are fitted to the lever supporting shafts 11 of the first connector housing 10 are located at the pivoting initial position P1 as shown in FIG. 11, the action receiving shafts 23 are engaged in the initial fitting engaging grooves 33 as shown in FIG. 13.

The cam grooves 34 are grooves that follow the initial fitting engaging grooves 33. The width of the cam grooves 34 is so set that the retaining flanges 23*b* are slideable. The cam grooves 34 are provided to extend from the initial fitting engaging grooves 33 into a shape that curves along the peripheral direction of the circular plates 31*b*. The cam grooves 34 are grooves that deepen the fitting of the connector housings 10, 20 with each other by acting a moving force in the fitting direction on the action receiving shafts 23 which are located in the initial fitting engaging grooves 33 with the pivoting of the lever bodies 31 when the lever bodies 31 are pivoted from the pivoting initial position P1 to a pivoting final position P2.

Figure 16:
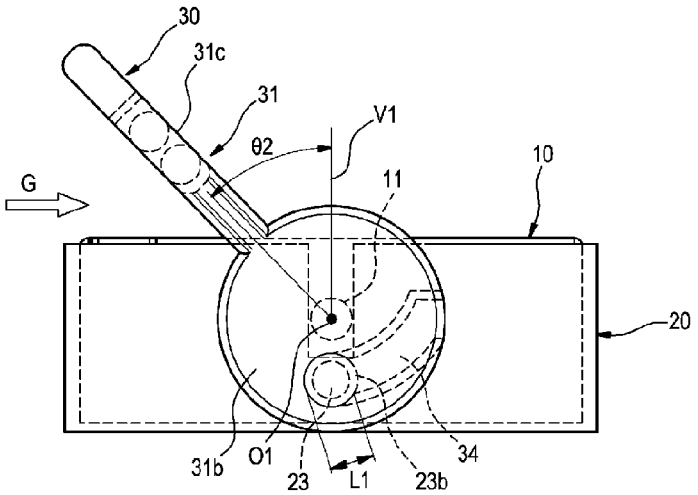
FIG. 16 is a side view of the lever connector shown in FIG. 15.

The pivoting final position P2 of the lever bodies 31 is a position where the extending direction of the rod-like parts 31*c* is inclined counterclockwise from the vertical line V1, which passes through the center O1 of the circular plates 31*b*, by θ2, as shown in FIG. 16. While the lever bodies 31 are pivoted to the pivoting final position P2, as shown in FIG. 16, the action receiving shafts 23 which are engaged in the cam grooves 34 arrive at the final ends of the cam grooves 34.

The lever retaining flanges 35 are brim-shaped structures which are equipped at the opening edges of the initial fitting engaging grooves 33 and the cam grooves 34 except the final end areas of the cam grooves 34 (ranges L1 in FIGS. 7 and 16) where the action receiving shafts 23 arrive when the lever bodies 31 arrive at the pivoting final position P2. The lever retaining flanges 35 are formed to project from the opening edges of the grooves so that the lever retaining flanges 35 abut against the inner surfaces of the retaining flanges 23*b* of the action receiving shafts 23 which are fitted in the cam grooves 34. The lever retaining flanges 35 abut against the inner surfaces of the retaining flanges 23*b* to regulate the lever bodies 31 from moving outward in the axial direction of the action receiving shafts 23.

That is, because the areas where the lever retaining flanges 35 are equipped are areas except the final end areas L1 of the cam grooves 34, in the extending areas of the initial fitting engaging grooves 33 and the cam grooves 34 except the final end areas L1, the movement of the lever bodies 31 in the axial direction of the action receiving shafts 23 is regulated, but in the final end areas L1, the movement of the lever bodies 31 is permitted.

The coupling mechanism 36 is a mechanism to couple the pair of lever bodies 31, 31 to be movable in the opposing direction (arrow Y4 direction of FIG. 5) from a minimum separation position which corresponds to the above-mentioned lever supporting shafts fitted state to a maximum separation position which corresponds to the above-mentioned lever supporting shafts detached state.

As shown in FIGS. 8 to 9, the coupling mechanism 36 in the present embodiment includes a coupling member 361 which is arranged between the pair of lever bodies 31, guiding shafts 362, guiding holes 363 and stoppers 364.

As shown in FIGS. 5 and 8, the coupling member 361 is a block-shaped member which is arranged between the ends of the rod-like parts 31*c* of the pair of lever bodies 31, 31. The coupling member 361 also serves as an operating part (force point part of the lever) which adds an operating force when the lever bodies 31 are pivoted.

The guiding shafts 362 are formed integrally with the lever bodies 31, as shown in FIG. 9. These guiding shafts 362 are provided to project from the rod-like parts 31*c* of the lever bodies 31 toward the coupling member 361. These guiding shafts 362 have such a pipe-shaped structure that resilient member accommodating spaces 362*a* are formed at the side of the coupling member 361.

The guiding holes 363 are holes into which the guiding shafts 362 are fitted slideably in the opposing direction of the pair of lever bodies 31, 31 (arrow Y5 direction of FIG. 9), and are formed as recesses on the end surfaces of the coupling member 361 that face the lever bodies 31.

The spaces which are defined with the bottoms of the guiding holes 363 and the resilient member accommodating spaces 362*a* of the guiding shafts 362 are spaces where the resilient members 37 to be described later are accommodated.

The stoppers 364 are members that stop the movement of the guiding shafts 362 that are engaged in the guiding holes 363 to the detaching direction when the pair of lever bodies 31, 31 move to the maximum separation position. The stoppers 364 in the present embodiment are screw members that are inserted through screw through holes 311 which are formed at the rod-like parts 31*c* of the lever bodies 31 and are screwed to the coupling member 361, as shown in FIG. 10. Heads 364*a* of the screw members regulate the movement to the outsides of the rod-like parts 31*c* (arrow Y6 direction of FIG. 10).

FIG. 10 shows that the pair of lever bodies 31, 31 move to the maximum separation position while the heads 364*a* of the stoppers 364 (screw members) abut against the rod-like parts 31*c*. The lever bodies 31, which are located at the maximum separation position as shown in FIG. 10, can move toward the coupling member 361 in the range of a gap C1 shown in FIG. 10, when the lever bodies 31 move on shafts 364*b* of the stoppers 364. When the lever bodies 31, which are located at the maximum separation position, move inward in the opposing direction in the range of the gap C1 and the rod-like parts 31*c* abut against positioning surfaces 361*a* of the coupling member 361, the lever bodies 31 become opposed to each lever at the minimum separation position.

The resilient members 37 are spring members which urge the pair of lever bodies 31, 31 in such a direction that the separation distance between the pair of lever bodies 31 increases. The resilient members 37 in the present embodiment are coiled compression springs which are installed in the guiding holes 363 and press to urge the guiding shafts 362 outward, as shown in FIGS. 8 and 9. As described earlier, the spaces which are defined with the bottoms of the guiding holes 363 and the resilient member accommodating spaces 362*a* of the guiding shafts 362 become spaces where the resilient members 37 are accommodated.

For the above-mentioned lever connector 1 of the embodiment, while the fitting lever 30 is in a no load state (state shown in FIG. 1) which is that an external force to make the pair of lever bodies 31, 31 approach each other is not received, the lever bodies 31 are maintained at the maximum separation position by the urging force from the resilient members 37. While the pair of lever bodies 31, 31 are maintained at the maximum separation position, the pair of lever supporting shafts 11, 11 of the first connector housing 10 can be put between the pair of lever bodies 31, 31 of the fitting lever 30.

Then, while the pair of lever supporting shafts 11, 11 of the first connector housing 10 are put between the pair of lever bodies 31, 31, when the position of the shaft fitting holes 32 of the pair of lever bodies 31, 31 are aligned to the position of the lever supporting shafts 11, and as shown with the arrows Y2 in FIG. 11, the pair of lever bodies 31, 31 are pressed to move to approach each other to the minimum separation position, the lever supporting shafts fitted state, which is that the lever supporting shafts 11 are pivotably fitted in the shaft fitting holes 32 of the lever bodies 31, is obtained.

Figure 14:
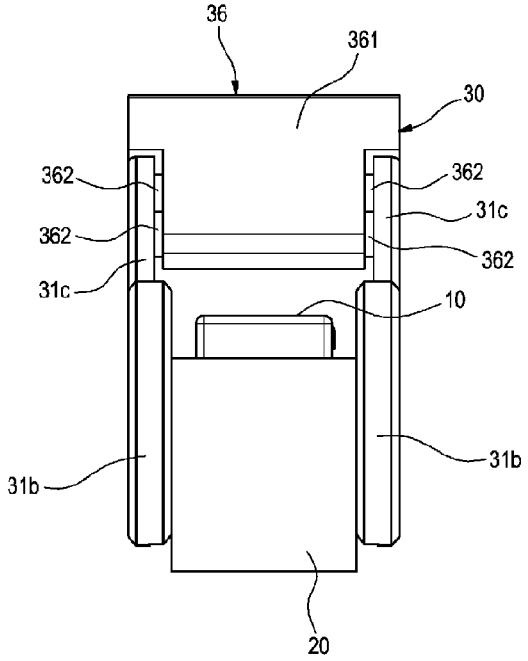
FIG. 14 is an F arrow view of FIG. 13.

Then, while the lever bodies 31 in the lever supporting shafts fitted state are positioned at the pivoting initial position P1 as shown in FIG. 11, when the first connector housing 10 is inserted into the outer sheath wall 21 of the second connector housing 20 and the first connector housing 10 and the second connector housing 20 are aligned at the fitting start position, the pair of action receiving shafts 23, 23 of the second connector housing 20 are engaged in the initial fitting engaging grooves 33 of the lever bodies 31, as shown in FIGS. 12-14.

While the action receiving shafts 23 are engaged in the initial fitting engaging grooves 33, as shown in FIG. 13, the lever retaining flanges 35 which are equipped at the opening edges of the initial fitting engaging grooves 33 engage with the inner surfaces of the retaining flanges 23*b* of the action receiving shafts 23 to regulate the movement of the lever bodies 31 outward in the axial direction of the action receiving shafts 23. That is, while the action receiving shafts 23 are engaged in the initial fitting engaging grooves 33, even if the load (the operating force) which urges the pair of lever bodies 31, 31 to approach each other is withdrawn, it is maintained that the pair of lever bodies 31, 31 are located at the minimum separation position.

Then, when the fitting lever 30 is pivoted to the pivoting final side as shown with the arrow R2 in FIG. 13, with the pivoting of the lever bodies 31, the cam grooves 34 act a moving force H (refer to FIG. 13) in the fitting direction of the connector housings 10, 20 on the action receiving shafts 23 which are located in the initial fitting engaging grooves 33 to deepen the fitting of the connector housings 10, 20 with each other. Then, with the pivoting of the fitting lever 30, as shown in FIGS. 15 and 16, when the lever bodies 31 arrive at the pivoting final position P2, the action receiving shafts 23 arrive at the final ends of the cam grooves 34, and the connector housings 10, 20 have been fitted and connected with each other.

Because the lever retaining flanges 35 are not equipped in the final end areas L1 of the cam grooves 34 as shown in FIG. 7, when the action receiving shafts 23 arrive at the final ends of the cam grooves 34, the movement of the pair of lever bodies 31 to the maximum separation position side is permitted due to the urging force of the resilient members 37. When the pair of lever bodies 31, 31 move to the maximum separation position, as shown in FIG. 17, the pair of lever bodies 31, 31 become detached from the lever supporting shafts 11 and the action receiving shafts 23. While the pair of lever bodies 31, 31 become detached from the lever supporting shafts 11 and the action receiving shafts 23, by performing an operation of pulling out the fitting lever 30 from the connector housing 10, 20 as shown with the arrow X4 in FIG. 18, the fitting lever 30 can be detached from the connector housings 10, 20 which are fitted and connected with each other.

Figure 15:
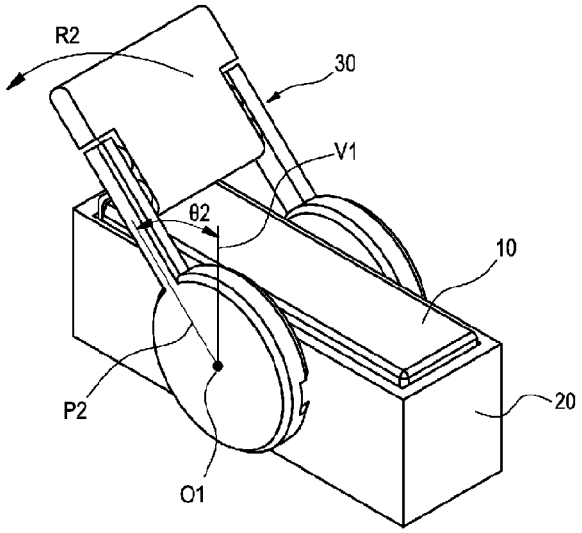
FIG. 15 is a perspective view which indicates that the fitting lever which is engaged with the first and second connector housings is pivoted in an arrow R2 direction to a pivoting final position.

When the detached fitting lever 30 is to be installed to the connector housings 10, 20 again, first, the fitting lever 30 is inserted onto the connector housings 10, 20 which are fitted and connected with each other, and the position of the fitting lever 30 is returned to the position where the pivoting of the lever bodies 31 has been completed as shown in FIGS. 15 and 16.

Then, when a load (operating force) to make the pair of lever bodies 31, 31 approach each other is applied to return the pair of lever bodies 31, 31 to the minimum separation position, a state is obtained which is that the lever bodies 31 are engaged with the lever supporting shafts 11 and the action receiving shafts 23 at the pivoting final position P2. Then, when the fitting lever 30 is pivoted from this state to the pivoting initial position P1, the connector housings 10, 20 can be returned to the fitting start position.

That is, according to the construction of the lever connector 1 shown in the embodiment, since after the connector housings 10, 20 have been fitted and connected with each other, the fitting lever 30 is detached from the connector housings 10, 20, a reduction in weight can be realized in an use state of the connector.

According to the construction of the lever connector 1 shown in the embodiment, the fitting lever 30 which is detached from the connector housings 10, 20 can be used in fitting other lever connectors. Therefore, the component set of a regular lever connector 1 only includes the first connector housing 10 and the second connector housing 20 but does not include the fitting operation lever 30, so that the cost can be reduced by reducing the number of components.

Further, according to the construction of the lever connector 1 shown in the embodiment, when the fitting and connection of the connector housings 10, 20 have been completed, since the pair of lever bodies 31, 31 are moved to the maximum separation position due to the urging force of the resilient members 37, the lever bodies 31 are detached from the lever supporting shafts 11 and the action receiving shafts 23, and the fitting lever 30 becomes detached from the connector housings 10, 20 automatically. However, in the middle of the fitting of the connector housings 10, 20 (that is, in the middle of the pivoting of the fitting lever 30), because the movement of the lever bodies 31 outward in the axial direction of the action receiving shafts 23 is regulated since the lever retaining flanges 35 which the lever bodies 31 are equipped with abut against the inner surfaces of the retaining flanges 23*b*, the fitting lever 30 cannot be detached from the connector housings 10, 20.

In other words, for the lever connector 1 shown in the embodiment, if the fitting lever 30 cannot be detached from the connector housings 10, 20, the connector housings 10, 20 are in the middle of fitting (half fitted state).Thus, it is possible to determine the fitted state of the connector housings 10, 20 based on whether the fitting lever 30 is automatically detached from the connector housings 10, 20, and it can be prevented that poor fitting of the connector housings 10, 20 with each other is overlooked.

Further, according to the construction of the lever connector 1 shown in the embodiment, since the guiding shafts 362 are formed integrally with the lever bodies 31, it can be prevented that the number of components is increased, and the coupling mechanism 36 which couples the pair of lever bodies 31 to be movable in the opposing direction from the maximum separation position to the maximum separation position can be realized with relatively less components.

Furthermore, according to the construction of the lever connector 1 shown in the embodiment, for example, since commercially available screw members are used as the stoppers 364, the procurement of the stoppers 364 becomes easy, and the manufacturing cost can be reduced.

Furthermore, if screw members are used as the stoppers 364, for example, by adjusting the threaded engagement depth of the screw members with the coupling member 361, the movable range of the pair of lever bodies 31, 31 in the opposing direction can be adjusted, and a design change of the movable range of the pair of lever bodies 31, 31 can be easily dealt with.

The present invention is not limited to the above-described embodiments, and suitable modifications, improvements and the like can be made. Moreover, the materials, shapes, dimensions, numbers, installation places, and the like of the components in the above embodiment are arbitrarily set as far as the invention can be attained, and not particularly restricted.

Although the present invention is described in detail with reference to the specific embodiments, it is apparent that various modifications and amendments may be made by those skilled in the art without departing from the spirit and scope of the present invention.

This application is based on the Japanese patent application (patent application No. 2012-034171) filed on Feb. 20, 2012, contents of which are incorporated herein by reference.

The features of the lever connector according to the embodiment of the present invention described above are briefly, collectively listed in the following [1] to [3], respectively.

[1] A lever connector comprising a first connector housing (10), a second connector housing (20) which is fitted and connected with the first connector housing (10), and a fitting lever (30) which is pivotably installed to the first connector housing (10) as a lever member to reduce the operating force to fit/detach the first connector housing (10) with/from the second connector housing (20), wherein the first connector housing (10) includes a pair of lever supporting shafts (11) which are respectively protruded from a pair of outer surfaces (10*a*) and with which the fitting lever (30) is pivotably fitted, the second connector housing (20) includes an outer sheath wall (21) which is fitted to the outer circumference of the first connector housing (10), a pair of fulcrum shaft guiding slots (22) which are formed by cutting a pair of side walls (21*a*) of the outer sheath wall (21) which face the pair of outer surfaces (10*a*) of the first connector housing (10) along the fitting direction of the connector housings so that when the connector housings are fitted with each other, the lever supporting shafts (11) project outward from the side walls (21*a*) and are movable in the fitting direction of the connector housings, and a pair of action receiving shafts (23) which are lined up in parallel with the lever supporting shafts (11) that project from the fulcrum shaft guiding slots (22) and which are protruded from the outer surfaces of the pair of side walls (21*a*) so that distal ends project slightly from distal ends of the lever supporting shafts (11) that project from the fulcrum shaft guiding slots (22), the action receiving shafts (23) include retaining flanges (23*b*) that project radially outward from the circumferences of the distal ends of the shafts, and the fitting lever (30) includes a pair of lever bodies (31) whose inner surfaces are arranged to face each other, shaft fitting holes (32) which are formed as recesses on the inner surfaces of the lever bodies (31) so that when the lever bodies (31) are moved along the central axis of the lever supporting shafts (11) from the outsides of the lever supporting shafts (11) to the insides of the shafts, a lever supporting shafts fitted state is obtained which is that the lever supporting shafts (11) are pivotably fitted, and when the lever bodies (11) are moved from the lever supporting shafts fitted state along the central axis of the lever supporting shafts (11) to the outsides of the lever supporting shafts (11), a lever supporting shafts detached state is obtained which is that the lever supporting shafts (11) are detached, initial fitting engaging grooves (33) which are formed to open at the end edges of the lever bodies (31) at the side of the second connector housing (20), and in which the action receiving shafts (23) are engaged when the first connector housing (10) and the second connector housing (20) are aligned at a fitting start position while the lever bodies (31) which are fitted with the lever supporting shafts (11) of the first connector housing (10) are located at a pivoting initial position, cam grooves (34) which follow the initial fitting engaging grooves (33) and which deepen the fitting of the connector housings by acting a moving force in the fitting direction on the action receiving shafts (23) which are located in the initial fitting engaging grooves (33) with the pivoting of the lever bodies (31) when the lever bodies (31) is pivoted from the pivoting initial position to a pivoting final position, lever retaining flanges (35) which are formed to project in such a way that the inner surfaces of the retaining flanges (23*b*) abut against the opening edges of the initial fitting engaging grooves (33) and the cam grooves (34) except final end areas of the cam groove (34) where the action receiving shafts (23) arrive when the lever bodies (31) arrive at the pivoting final position, so that the movement of the lever bodies (31) outward in the axial direction of the action receiving shafts (23) is regulated except the final end areas and is permitted in the final end areas, a coupling mechanism (36) which couples the pair of lever bodies (31) to be movable in the opposing direction from a minimum separation position corresponding to the lever supporting shafts fitted state to a maximum separation position corresponding to the lever supporting shafts detached state, and resilient members (37) which urge the pair of lever bodies (31) in such a direction that the separation distance between the pair of lever bodies (31) increases.

[2] The lever connector as recorded in the above [1], wherein the coupling mechanism (36) includes a coupling member (361) which is arranged between the pair of lever bodies (31), guiding shafts (362) which project from the lever bodies (31) toward the coupling member (361), guiding holes (363) which are formed as recesses on the end surfaces of the coupling member (361) that face the lever bodies (31) and in which the guiding shafts (362) are fitted slideably in the opposing direction of the pair of lever bodies (31), and stoppers (364) which stop the movement of the guiding shafts (362) that are fitted in the guiding holes (363) to a detaching direction when the pair of lever bodies (31) move to the maximum separation position, and the resilient members (37) are springs which press to urge the guiding shafts (362), which are installed in the guiding holes (363), outward.

[3] The lever connector as recorded in the above [2], wherein the stoppers (364) are screw members which are inserted through screw through holes (311) which the lever bodies (31) are formed with and are screwed to the coupling member (361).

INDUSTRIAL APPLICABILITY

According to the lever connector of the present invention, after the connector housings have been fitted with each other, the fitting lever is detached from the connector housings so that a reduction in weight can be realized in an use state of the connector.

The present invention which has the above effect is useful in the field of lever connector.

REFERENCE SIGN LIST

1 lever connector
10 first connector housing
10*a* outside surface
11 lever supporting shaft
20 second connector housing
21 outer sheath wall
21*a* side wall
22 fulcrum shaft guiding slot
23 action receiving shaft
23*b* retaining flange
30 fitting lever
31 lever body
31*a* inner surface
32 shaft fitting hole
33 initial fitting engaging groove
34 cam groove
35 lever retaining flange
36 coupling mechanism
37 resilient member
311 screw through hole
361 coupling member
362 guiding shaft
363 guiding hole
364 stopper L1 final end area
P1 pivoting initial position
P2 pivoting final position
The invention claimed is:

1. A lever connector comprising
a first connector housing;
a second connector housing which is fitted and connected with the first connector housing; and
a fitting lever which is pivotably installed to the first connector housing as a lever member to reduce the operating force to fit and detach the first connector housing with and from the second connector housing,
wherein the first connector housing includes a pair of lever supporting shafts which are respectively protruded from a pair of outer surfaces of the first connector housing and with which the fitting lever is pivotably fitted,
the second connector housing includes:
an outer sheath wall which is fitted to the outer circumference of the first connector housing;
a pair of fulcrum shaft guiding slots which are formed by cutting a pair of side walls of the outer sheath wall which face the pair of outer surfaces of the first connector housing along a fitting direction of the connector housings so that when the connector housings are fitted with each other, the lever supporting shafts project outward from the side walls and are movable in the fitting direction of the connector housings; and
a pair of action receiving shafts which are lined up in parallel with the lever supporting shafts that project from the fulcrum shaft guiding slots and which are protruded from the outer surfaces of the pair of side walls so that distal ends of the action receiving shafts project slightly from distal ends of the lever supporting shafts that project from the fulcrum shaft guiding slots,
the action receiving shafts includes retaining flanges that project radially outward from the circumferences of the distal ends of the shafts, and
the fitting lever includes:
a pair of lever bodies whose inner surfaces are arranged to face each other
shaft fitting holes which are formed as recesses on the inner surfaces of the lever bodies so that when the lever bodies are moved along a central axis of the lever supporting shafts from an outsides of the lever supporting shafts to an insides of the shafts,
a lever supporting shafts fitted state is obtained which is that the lever supporting shafts are pivotably fitted to the shaft fitting holes, and when the lever bodies are moved from the lever supporting shafts fitted state along the central axis of the lever supporting shafts to the outsides of the lever supporting shafts,
a lever supporting shafts detached from the shaft fitting holes state is obtained which is that the lever supporting shafts are detached;
initial fitting engaging grooves which are formed to open at end edges of the lever bodies at the side of the second connector housing, and in which the action receiving shafts are engaged when the first connector housing and the second connector housing are aligned at a fitting start position while the lever bodies which are fitted with the lever supporting shafts of the first connector housing are located at a pivoting initial position,
cam grooves which follow the initial fitting engaging grooves and which deepen the fitting of the connector housings by acting a moving force in the fitting direction on the action receiving shafts which are located in the initial fitting engaging grooves with the pivoting of the lever bodies when the lever bodies are pivoted from the pivoting initial position to a pivoting final position,
lever retaining flanges which are formed to project on opening edges of the initial fitting engaging grooves and the cam grooves except final end areas of the cam grooves where the action receiving shafts arrive when the lever bodies arrive at the pivoting final position to abut against an inner surface of the retaining flanges, so that the movement of the lever bodies outward in the axial direction of the action receiving shafts is regulated by the lever retaining flanges except the final end areas and is permitted in the final end areas,
a coupling mechanism which couples the pair of lever bodies to be movable in the opposing direction from a minimum separation position corresponding to the lever supporting shafts fitted state to a maximum separation position corresponding to the lever supporting shafts detached state, and
resilient members which urge the pair of lever bodies in such a direction that the separation distance between the pair of lever bodies increases.

2. The lever connector according to claim 1,
wherein the coupling mechanism includes:
a coupling member which is arranged between the pair of lever bodies;
guiding shafts which project from the lever bodies toward the coupling member;
guiding holes which are formed as recesses on the end surfaces of the coupling member that face the lever bodies and in which the guiding shafts are fitted slideably in the opposing direction of the pair of lever bodies; and
stoppers which stop the movement of the guiding shafts that are fitted in the guiding holes to a detaching direction when the pair of lever bodies move to the maximum separation position, and
the resilient members are springs which press to urge the guiding shafts, which are installed in the guiding holes, outward.

3. The lever connector according to claim 2, wherein the stoppers are screw members which are inserted through screw through holes with which the lever bodies are formed and are screwed to the coupling member.

4. A lever connector comprising
a first connector housing;
a second connector housing which is fitted and connected with the first connector housing; and
a fitting lever which is pivotably installed to the first connector housing as a lever member to reduce the operating force to fit and detach the first connector housing with and from the second connector housing,
wherein the first connector housing includes a pair of lever supporting shafts which are respectively protruded from a pair of outer surfaces of the first connector housing and with which the fitting lever is pivotably fitted,
wherein the second connector housing includes:
an outer sheath wall which receives an outer periphery of the first connector housing;
a pair of fulcrum shaft guiding slots formed in a pair of side walls of the outer sheath wall which face the pair of outer surfaces of the first connector housing along a fitting direction of the connector housings so that when the connector housings are fitted with each other, the lever supporting shafts project outward from the side walls and are movable in the fitting direction; and a pair of action receiving shafts which are lined up in parallel with the lever supporting shafts which are protruded from the outer surfaces of the pair of side walls so that distal ends of the action receiving shafts project slightly from distal ends of the lever supporting shafts that project from the fulcrum shaft guiding slots, the action receiving shafts including retaining flanges that project radially outward from distal ends of the action receiving shafts, and wherein the fitting lever includes:

a pair of lever bodies with inner surfaces arranged to face each other, the inner surfaces comprising:

shaft fitting holes which are formed as recesses on the inner surfaces of the lever bodies and which align with a central axis of the lever supporting shafts, whereby the lever bodies are movable along the central axis between:

a lever supporting shafts fitted state wherein the lever bodies are moved inwardly such that the lever supporting shafts are pivotably fitted within the shaft fitting holes, and a lever supporting shafts detached state wherein the lever bodies are moved outwardly such that the lever supporting shafts are detached from the shaft fitting holes;

initial fitting engaging grooves which are formed to open at an outer peripheral edge of the inner surfaces of the lever bodies, and in which the action receiving shafts are engaged when the first connector housing and the second connector housing are aligned at a fitting start position and the fitting lever is located at a pivoting initial position, arcuate cam grooves which extend from inner ends of the initial fitting engaging grooves and in which the action receiving shafts are guided to move in the fitting direction when the fitting lever is pivoted from the pivoting initial position to a pivoting final position, and wherein a width of the arcuate cam grooves is substantially equal to a width of the distal ends of the action receiving shafts to allow the distal ends to slide within a lower portion of the cam grooves, and lever retaining flanges which are formed at an upper portion of the arcuate cam grooves and project inwardly from sides of both the initial fitting engaging grooves and the arcuate cam grooves, such that a distance between the lever retaining flanges is less than the width of the distal ends of the action receiving shafts, the lever retaining flanges terminating at final end areas of the cam grooves, where the action receiving shafts arrive when the fitting lever is moved to the pivoting final position, so that that movement of the lever bodies outward in the axial direction of the lever supporting shafts is permitted in the final end areas, a coupling mechanism which couples the pair of lever bodies to be moveable between the lever supporting shafts fitted state and the lever supporting shafts detached state, and resilient members which urge the pair of lever bodies in such a direction that the separation distance between the pair of lever bodies increases.

5. The lever connector according to claim 4, wherein the coupling mechanism, includes:

a coupling member which is arranged between the pair of the lever bodies;

guiding shafts which project from the lever bodies toward the coupling member;

guiding holes which are formed as recesses on the end surfaces of the coupling member that face the lever bodies and in which the guiding shafts are fitted slidably in the opposing direction of the pair lever bodies; and stoppers which stop the movement of the guiding shafts that are fitted in the guiding holes to a detaching direction when the pair of lever bodies move to the maximum separation position, and the resilient members are springs which press to urge the guiding shafts, which are installed in the guiding holes, outward.

6. The lever connector according to claim 5, wherein the stoppers are screw members which are inserted through screw through holes with which the lever bodies are formed and are screwed to the coupling member.

* * * * *